US011542067B2

(12) United States Patent
Forrest

(10) Patent No.: US 11,542,067 B2
(45) Date of Patent: Jan. 3, 2023

(54) RELEASABLE CONTAINER CAP

(71) Applicant: Paul Bradley Forrest, Cary, NC (US)

(72) Inventor: Paul Bradley Forrest, Cary, NC (US)

( * ) Notice: Subject to any disclaimer, the term of this patent is extended or adjusted under 35 U.S.C. 154(b) by 0 days.

(21) Appl. No.: 17/318,712

(22) Filed: May 12, 2021

(65) Prior Publication Data

US 2022/0363446 A1 Nov. 17, 2022

(51) Int. Cl.
*B65D 41/34* (2006.01)
*B65D 1/02* (2006.01)

(52) U.S. Cl.
CPC ..... *B65D 41/3428* (2013.01); *B65D 1/0246* (2013.01)

(58) Field of Classification Search
CPC .... B65D 41/3428; B65D 1/0246; B29C 49/52
USPC ..... 215/901, 252, 329, 216
See application file for complete search history.

(56) References Cited

U.S. PATENT DOCUMENTS 2,169,686 A * 8/1939 Fabrice ..... B65D 41/348 215/901
3,703,975 A * 11/1972 Wittemer ..... G11C 11/40 220/212.5
3,993,208 A * 11/1976 Ostrowsky ..... B65D 50/046 215/320
4,166,552 A * 9/1979 Faulstich ..... B65D 41/485 215/901
4,436,211 A * 3/1984 Gach ..... B65D 50/046 215/216
4,452,363 A * 6/1984 Davis ..... B65D 41/3452 215/258
4,480,762 A * 11/1984 Thomas ..... B65D 50/045 215/280
4,572,389 A * 2/1986 Gach ..... B65D 41/34 215/253
4,752,013 A * 6/1988 Miller ..... B65D 41/3409 215/253
5,431,305 A * 7/1995 Kaminski ..... B65D 47/244 222/521

(Continued)

OTHER PUBLICATIONS

ISA/US; International Search Report and Written Opinion for International Patent Application No. PCT/US2022/029032 dated Aug. 16, 2022, 8 pages.

*Primary Examiner* — Steven A. Reynolds
*Assistant Examiner* — Prince Pal
(74) *Attorney, Agent, or Firm* — NK Patent Law

(57) ABSTRACT

A container has an improved releasable cap, the container including a neck having external threads. The cap includes: a circular top piece for sealing the container; two sidewall sections connected to the top piece each having an internal threaded portion for engaging the neck of the container. Each sidewall section has two circumferential ends each spaced from an adjacent circumferential end of the other sidewall section such that two diametrically opposed expandable gaps are defined between the spaced circumferential ends. Two tabs each span a respective one of the two gaps, the tabs bulging outward from the sidewall section. The tabs are configured to be pressed inward thereby causing the sidewall sections to flex outward to disengage the internal threaded portions thereof from the external threads of the neck of the container permitting the cap to be removed therefrom.

16 Claims, 4 Drawing Sheets

(56) References Cited

U.S. PATENT DOCUMENTS 5,603,421 A * 2/1997 Opresco ..... B65D 50/046 215/217
5,642,825 A * 7/1997 Wohlgemuth ..... B65D 41/47 215/901
5,687,863 A * 11/1997 Kusz ..... B65D 41/0471 215/331
5,836,466 A * 11/1998 Briere ..... B65D 50/046 215/217
5,915,576 A * 6/1999 Robinson ..... B65D 50/046 215/334
5,941,404 A * 8/1999 Charrette ..... B65D 41/04 D9/520
6,089,390 A * 7/2000 Druitt ..... B65D 41/3447 215/307
6,102,223 A * 8/2000 Montgomery ..... B65D 50/046 215/44
6,112,921 A * 9/2000 Robinson ..... B65D 50/046 215/221
6,253,942 B1 * 7/2001 Elias ..... B65D 41/0485 D9/451
6,332,550 B1 * 12/2001 Bennett ..... B65D 41/62 220/255
6,726,042 B2 * 4/2004 Schweigert ..... B65D 41/3447 215/901
6,811,047 B1 * 11/2004 Hicks ..... B65D 41/0421 215/305
6,886,708 B2 * 5/2005 Kaufman ..... B65D 83/40 220/257.1
7,513,377 B1 * 4/2009 Culley ..... B65D 41/3428 215/901
8,245,880 B1 * 8/2012 Bragg ..... B65D 47/242 215/221
8,302,794 B2 * 11/2012 Russell ..... B65D 41/3423 215/258
8,763,830 B2 * 7/2014 Sadiq ..... B65D 41/3428 215/901
9,771,190 B2 * 9/2017 Piscopo ..... B65D 50/046
9,889,977 B2 * 2/2018 Piscopo ..... B65D 50/046
10,414,551 B2 * 9/2019 Martini ..... B65D 41/0485
10,556,403 B2 * 2/2020 Cavanna ..... B29C 65/3668
2002/0066713 A1 * 6/2002 Ma ..... B65D 41/3428 215/252
2003/0173325 A1 9/2003 Mavin
2003/0201283 A1 * 10/2003 Branson ..... B65D 47/0814 222/153.14
2004/0074919 A1 * 4/2004 Knickerbocker .... B65D 50/046 222/1
2004/0262251 A1 * 12/2004 Tauber ..... B65D 50/041 215/220
2005/0023238 A1 2/2005 Wong
2005/0133475 A1 * 6/2005 Goto ..... B65D 50/046 215/237
2006/0213860 A1 * 9/2006 Robinson ..... B65D 50/046 215/331
2008/0067142 A1 * 3/2008 Druitt ..... B65D 41/04 215/324
2008/0245796 A1 * 10/2008 Gnepper ..... A61J 1/03 220/281
2009/0045158 A1 * 2/2009 Suriol ..... B65D 41/0435 215/256
2009/0178995 A1 * 7/2009 Tung ..... B65D 1/0246 215/316
2010/0025355 A1 * 2/2010 Beecroft ..... B65D 50/046 215/216
2010/0059518 A1 * 3/2010 Brozell ..... B65D 41/0471 220/323
2011/0094990 A1 * 4/2011 Sprishen ..... B65D 50/041 215/217
2011/0290756 A1 12/2011 Horstman
2012/0091134 A1 4/2012 Sadiq et al.
2013/0097973 A1 * 4/2013 McCoy ..... B65B 7/2835 215/200
2014/0138380 A1 * 5/2014 Fox ..... B65D 51/245 220/214
2015/0014269 A1 * 1/2015 Gillman ..... B65D 50/041 215/217
2016/0016703 A1 * 1/2016 Mühlemann ..... B65D 41/62 222/566
2016/0145016 A1 * 5/2016 Miceli ..... B65D 50/046 215/215
2016/0176586 A1 * 6/2016 Mélan-Moutet ... B65D 41/0414 215/252
2016/0176590 A1 * 6/2016 Prater ..... B65D 85/70 215/44
2016/0347512 A1 * 12/2016 Horner ..... B65D 41/04
2017/0021978 A1 * 1/2017 Keener ..... B65D 41/0414
2017/0203889 A1 * 7/2017 Butter-Jentsch ..... B65D 50/04
2017/0273435 A1 * 9/2017 Megaro ..... B05B 11/0037
2017/0349341 A1 * 12/2017 Girardot ..... B65D 50/043
2018/0215512 A1 * 8/2018 Toh ..... B65D 1/0246
2018/0327146 A1 * 11/2018 Martini ..... B65D 41/3428
2019/0210777 A1 * 7/2019 McNabb ..... B65D 50/046
2019/0276201 A1 * 9/2019 French ..... B65D 50/043
2020/0198855 A1 * 6/2020 Sterling ..... B65D 50/043
2020/0246221 A1 * 8/2020 Gloria Bello ..... B65D 41/0421
2020/0339320 A1 * 10/2020 Biesecker, II ..... B65D 51/245
2021/0031983 A1 * 2/2021 Azelton ..... B65D 50/048
2021/0188499 A1 * 6/2021 Ekkert ..... B65D 50/061
2021/0371173 A1 * 12/2021 Sterling ..... B65D 55/024
2022/0048681 A1 * 2/2022 Grabarczyk ..... B65D 41/485

* cited by examiner

RELEASABLE CONTAINER CAP

TECHNICAL FIELD

The present disclosure relates to caps for containers for fluids such as beverages and others. More particularly, the present disclosure relates to a releasable container cap having releasable threads or other inward protruding male engagement features such as a rib or ring.

BACKGROUND

Conventional containers such as beverage bottles have threaded caps that are removed by rotation. Removal of the cap can take several turns before the threads of the cap are disengaged from the threaded neck of the container, and for some, both hands are required for the operation. In some uses, for example when driving or otherwise occupied, conventional caps are challenging or inconvenient. An improved container cap is needed.

SUMMARY

This summary is provided to briefly introduce concepts that are further described in the following detailed descriptions. This summary is not intended to identify key features or essential features of the claimed subject matter, nor is it to be construed as limiting the scope of the claimed subject matter.

An improved releasable container cap according to at least one embodiment includes: a circular top piece for sealing a container; two sidewall sections connected to the top piece, each sidewall section having an internal threaded portion for engaging threads of the container, each sidewall section having two circumferential ends. Each circumferential end of each sidewall section is spaced from an adjacent circumferential end of the other sidewall section such that two diametrically opposed expandable gaps are formed as hollow protrusions defined between the spaced circumferential ends; and two tabs each spanning a respective one of the two gaps, the tabs bulging outward from the sidewall sections, wherein the tabs are configured to be pressed inward thereby causing the sidewall sections to flex outward to disengage the threads of the container permitting the cap to be removed therefrom. The hollow protruding tabs provide open space to allow compression without interrupting the continuous perimeter of the cap and hollow protrusions combined.

A container has an improved releasable cap according to at least one embodiment, the container including a neck having external threads. The cap includes: a circular top piece for sealing the container; two sidewall sections connected to the top piece, each sidewall section having an internal threaded portion for engaging the external threads of the neck of the container, each sidewall section having two circumferential ends, wherein each circumferential end of each sidewall section is spaced from an adjacent circumferential end of the other sidewall section such that two diametrically opposed expandable gaps are defined between the spaced circumferential ends; and two tabs each spanning a respective one of the two gaps, the tabs bulging outward from the sidewall sections, wherein the tabs are configured to be pressed inward thereby causing the sidewall sections to flex outward to disengage the internal threaded portions thereof from the external threads of the neck of the container permitting the cap to be removed therefrom.

Each tab may include two ends each connected to a respective sidewall section adjacent a circumferential end of the sidewall section, and a central part between the two ends, the central part spanning the respective gap.

The gaps may expand when the sidewall sections flex outward.

The tabs may be tapered, reducing radially toward the top piece.

The tabs may be configured to be pressed inward along a first diametric axis causing the sidewall sections to flex outward in opposite directions along a second diametric axis perpendicular to the first diametric axis.

The cap may be configured to be removed from the container by rotation without the tabs being pressed.

The internal threaded portion of each sidewall section may have threads having at least one tapered circumferential end.

A tamper-proof ring may be attached to the sidewall sections by frangible strips.

The above summary is to be understood as cumulative and inclusive. The above described embodiments and features are combined in various combinations in whole or in part in one or more other embodiments.

BRIEF DESCRIPTION OF THE DRAWINGS

The previous summary and the following detailed descriptions are to be read in view of the drawings, which illustrate particular exemplary embodiments and features as briefly described below. The summary and detailed descriptions, however, are not limited to only those embodiments and features explicitly illustrated.

DETAILED DESCRIPTIONS

Figure 1:
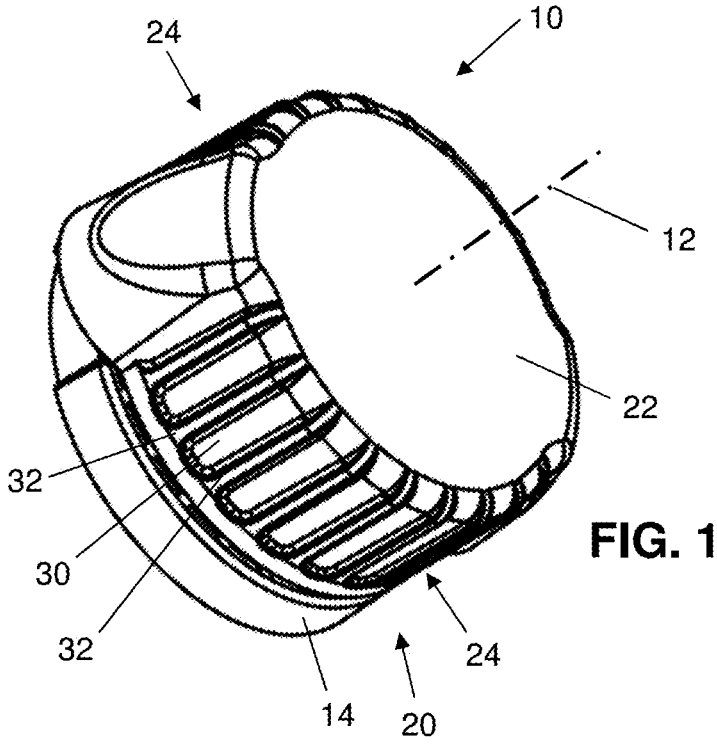
FIG. 1 is a perspective view of an improved releasable container cap, according to at least one embodiment.

These descriptions are presented with sufficient details to provide an understanding of one or more particular embodiments of broader inventive subject matters. These descriptions expound upon and exemplify particular features of those particular embodiments without limiting the inventive subject matters to the explicitly described embodiments and features. Considerations in view of these descriptions will likely give rise to additional and similar embodiments and features without departing from the scope of the inventive subject matters. Although steps may be expressly described or implied relating to features of processes or methods, no implication is made of any particular order or sequence among such expressed or implied steps unless an order or sequence is explicitly stated.

Any dimensions expressed or implied in the drawings and these descriptions are provided for exemplary purposes. Thus, not all embodiments within the scope of the drawings and these descriptions are made according to such exemplary dimensions. The drawings are not made necessarily to scale. Thus, not all embodiments within the scope of the drawings and these descriptions are made according to the apparent scale of the drawings with regard to relative dimensions in the drawings. However, for each drawing, at least one embodiment is made according to the apparent relative scale of the drawing.

Like reference numbers used throughout the drawings depict like or similar elements. Unless described or implied as exclusive alternatives, features throughout the drawings and descriptions should be taken as cumulative, such that features expressly associated with some particular embodiments can be combined with other embodiments.

Figure 2:
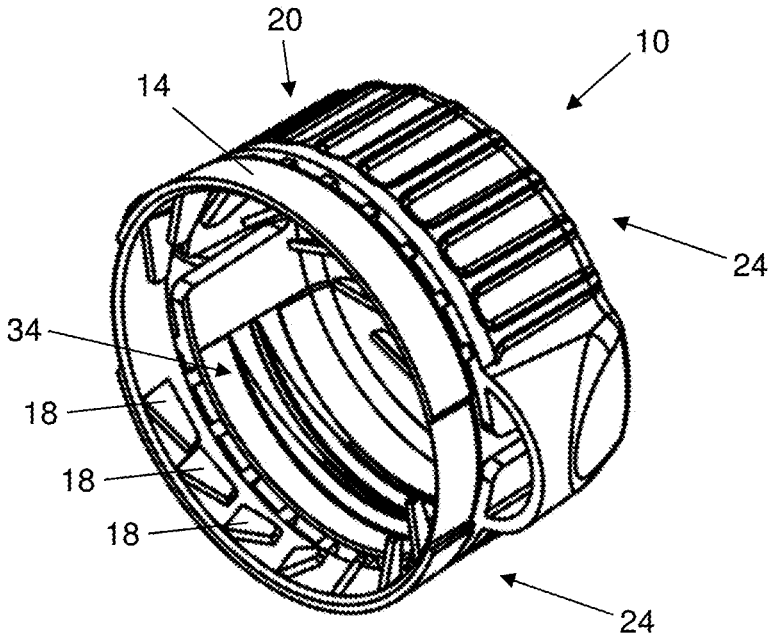
FIG. 2 is another perspective view of the cap of FIG. 1.
Figure 3:
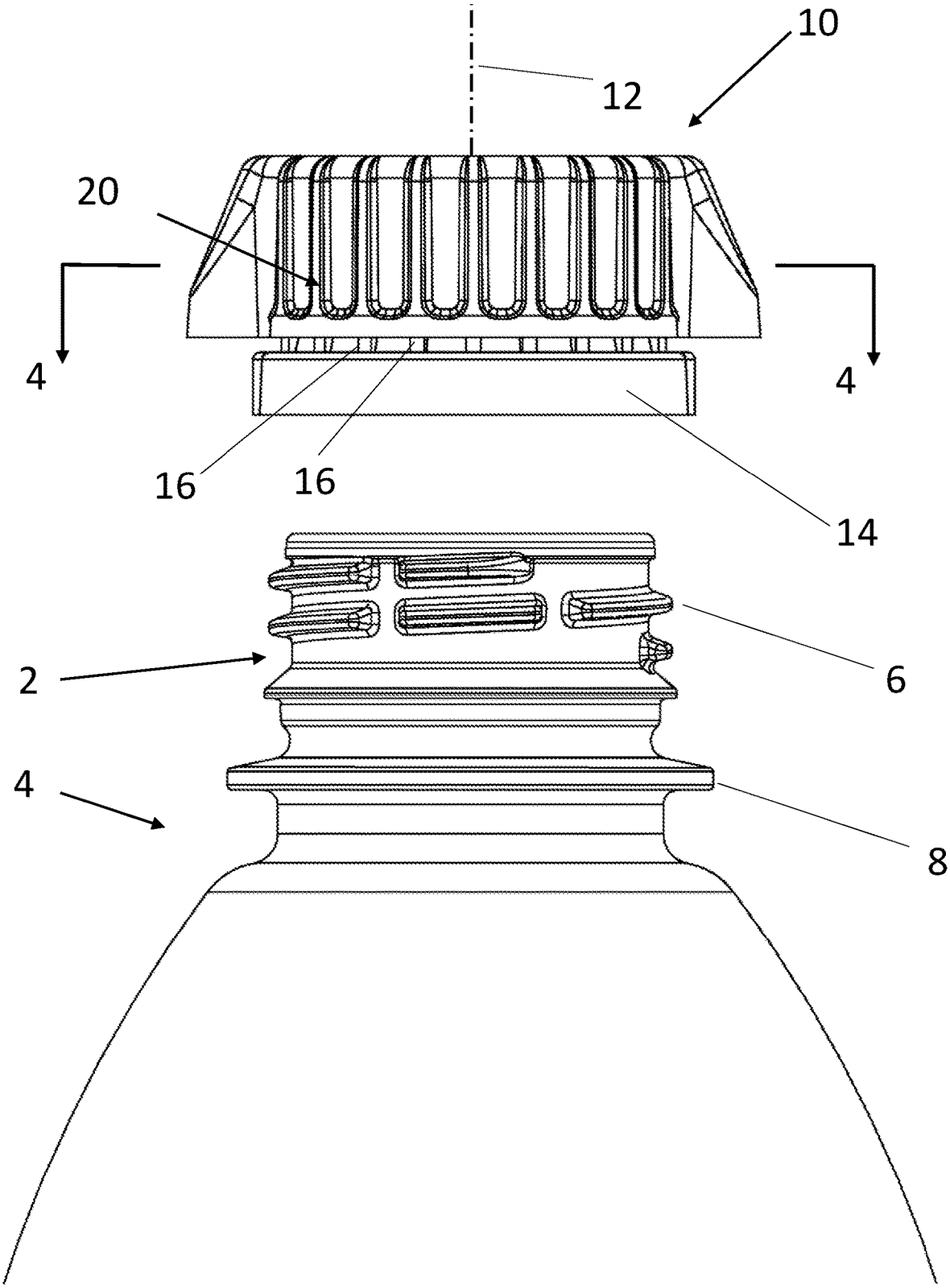
FIG. 3 is a side view of the cap of FIG. 1 aligned with the neck of an exemplary container.

An improved releasable container cap 10 having releasable threads, according to at least one embodiment, is shown in FIGS. 1-8. From a use perspective, the container cap 10 can be used conventionally in that, once mounted on the threaded neck 2 of a container 4, a non-limiting example of which is shown in FIG. 3 for illustration of use of the container cap 10. The container 4 is partially illustrated, showing particularly its top end, representing that the container can have any volume and overall size. The cap 10 can be removed by user action rotating the cap 10 around its longitudinal axis 12. The rotation causes the cap 10 to advance along the neck 2 of a container, as internal helical threads of the cap 10 engaging corresponding external threads 6 of the container neck 2 advance the cap 10, until the cap 10 is removed. A tamper-proof security ring 14 attached to the sidewall sections of the main body 20 of the cap 10 by frangible strips 16 is removed from the main body by breaking of the strips as the cap 10 is removed from the container. Flaps 18 (FIG. 1) along the interior of the tamper-proof ring 14 keep the ring centered beyond a fixed ring 8 (FIG. 3) on the neck 2 to keep the ring 14 on the container 4 as the cap 10 is removed.

Once removed or loosened by rotation, the cap 10 can be tightened to reseal a container by opposite rotation and threaded re-engagement. The cap 10 can be repeatedly used in this fashion.

The container cap 10 also has novel features advantageously improved over prior container caps 10 that are also used conventionally as just described. In particular, the cap 10 has releasable internal threads that are disengaged from the threaded neck of a container when unique tabs are pressed by user action, permitting the cap 10 to be removed without necessitating its rotation.

Figure 7:
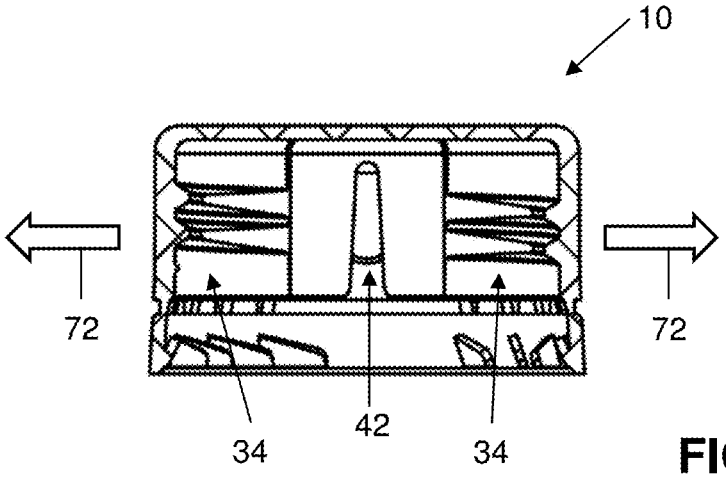
FIG. 7 is a cross-sectional side view of the cap of FIG. 1 as taken along the line 7-7 in FIG. 6.
Figure 8:
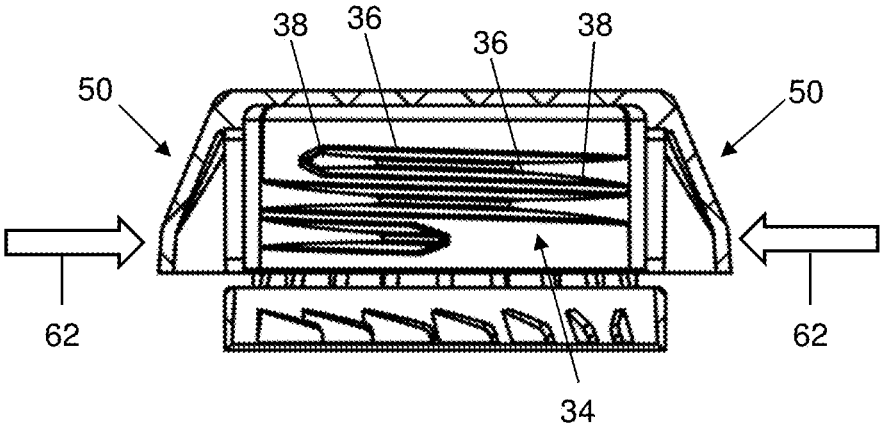
FIG. 8 is a cross-sectional side view of the cap of FIG. 1 as taken along the line 8-8 in FIG. 6.

Describing now in detail the structural features of the container cap 10, the main body 20 has a generally circular top piece 22 defining a longitudinal end of the cap 10. Two sidewall sections 24 are connected to and integral with the top piece 22 along its circular perimeter and extend longitudinally therefrom to define an interior 26 (FIG. 6) of the cap 10 for receiving and engaging the threaded neck of a container in use. The exterior surfaces 30 of the sidewall sections 24 configured to be gripped, having longitudinally extending grip ridges 32 in the illustrated embodiment. The interior surfaces of the sidewall sections 24 each have a respective threaded portion 34 (FIG. 2, FIG. 7). The two threaded portions 34 of the two sidewall sections 24 cooperate to engage the threaded neck of a container in use as the top piece 22 seals the container. The threads 36 (FIGS. 7-8) of the threaded portions 34 can have an industry standard pitch or customized pitch to match a preferred use and container 4 such as that shown in FIG. 3.

Each sidewall section 24 is formed as a partial semicircle and thus wraps circumferentially around the longitudinal axis 12 by less than one hundred and eighty degrees. Thus, the circumferential ends 40 (FIG. 4) of the two sidewall sections 24 do not meet. Instead, each circumferential end 40 of each sidewall section 24 is spaced from an adjacent circumferential end 40 of the other sidewall section such that two diametrically opposed expandable gaps 42 are defined between the spaced circumferential ends 40. The gaps 42 are minimized in an engagement configuration of the cap 10, which is illustrated in the drawings, referring to the cap 10 in use or ready for use in engaging the threaded neck of a container and sealing the container.

A respective operable tab 50 spans each gap along the exterior of the cap 10. Each tab has two ends 52 (FIG. 4), each connected to a respective sidewall section 24 adjacent the circumferential end 40 of the sidewall section. A central part 54 of each tab 50, between the two ends 52 thereof, bulges radially outward over and spans a respective gap 42. The tabs 50 may be tapered as illustrated, reducing radially toward the top piece 22 of the cap 10 to provide a comfortable overall form and minimize the likelihood of snagging on other items when handled. Thus, as described and shown in the drawings, the tabs can be described as hollow protrusions in that each has an open interior space to allow its compression without interrupting the continuous perimeter of the cap and tabs combined.

Figure 4:
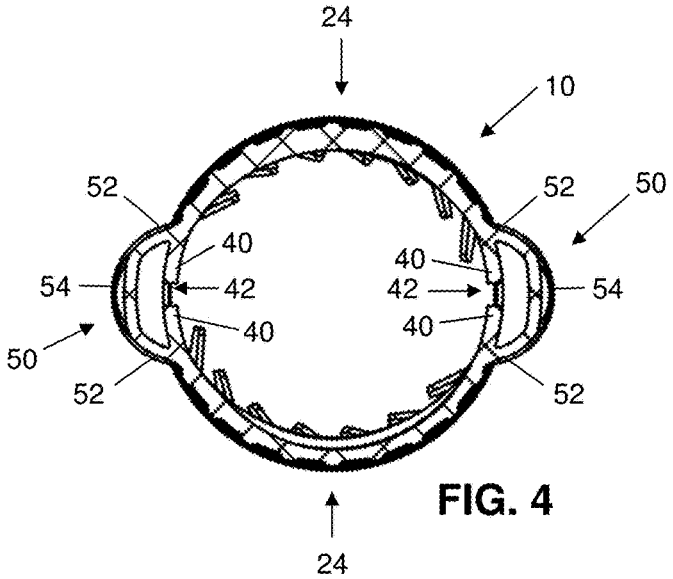
FIG. 4 is a cross-sectional longitudinal view of the cap of FIG. 1 as taken along the line 4-4 in FIG. 3.
Figure 5:
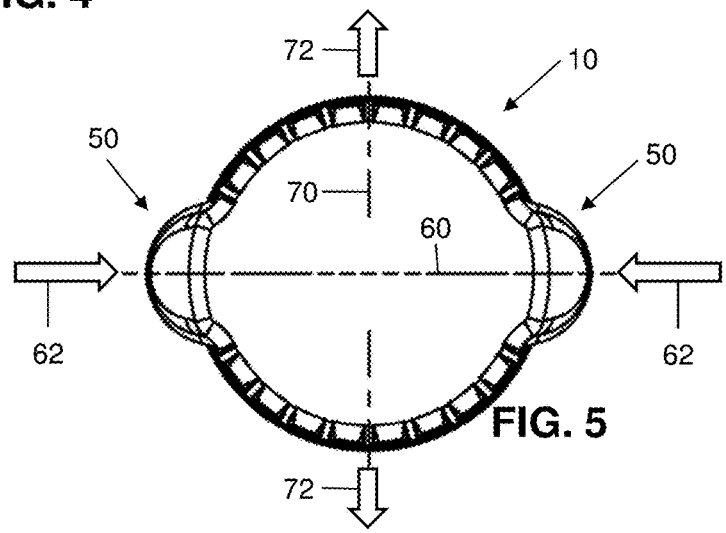
FIG. 5 is top view of the cap of FIG. 1.
Figure 6:
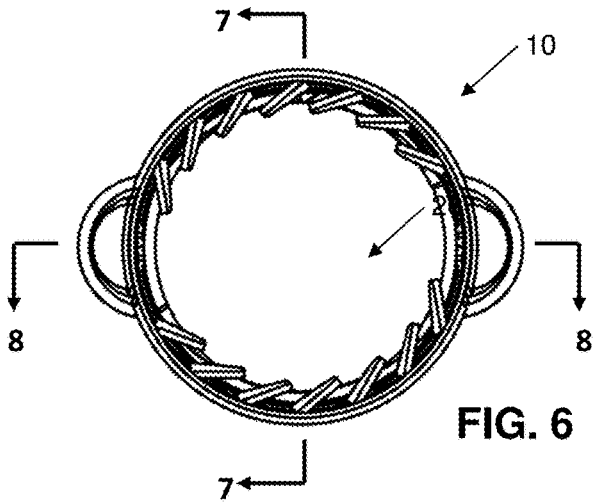
FIG. 6 is a bottom view of the cap of FIG. 1.

The tabs 50 are diametrically opposed. A first diametric axis 60 between the two tabs 50 crosses the longitudinal axis 12 that defines the center of the cap 10. The tabs 50 are operated by user action, for example with an index finger and thumb, pressing them radially inward at the central parts 54 as represented by opposing pinching forces 62 in FIG. 5. This causes: the central parts 54 of the tabs 50 to move inward; the gaps 42 to be expanded; and the sidewall sections 24 to be flexed in radially outward opposite directions 72 along a second diametric axis 70 as represented in FIG. 4. In the illustrated embodiment of the cap 10, the first diametric axis 60, the second diametric axis 70, and the longitudinal axis 12 are mutually orthogonal.

As the sidewall sections 24 are flexed radially outward by user action pinching the central parts 54 of the operable tabs 50 radially inward, the threaded portions 34 of the two sidewall sections 24 are carried radially outward from the illustrated engagement configuration to disengage the threaded neck 2 of a container 4, permitting the cap 10 to be removed therefrom without rotation around the longitudinal axis by lifting the cap along the axis 12 away from the neck of the container. The sidewall sections are disallowed from flexing until the tamper-proof ring 14 is separated from the cap.

The threads 36 of the threaded portions 34 of the two sidewall sections 24 have tapered circumferential ends 38 (FIG. 8) to facilitate smooth use when the cap 10 is rotated and to facilitate disengagement when the tabs 50 are operated. The tabs 50, by spanning and thereby shrouding or overhanging the gaps 42, promote cleanliness from dust at the threaded neck of a container.

The cap 10 can be fabricated as a unitary item by, for example, injection molding. A resilient and durable material, such as plastic, can be used to facilitate multiple uses of the cap 10 on a host container. For example, once removed from a container by disengagement of the threads 36 by user force on the operable tabs 50, or the cap 10 can be returned to the container by rotation and threaded engagement to reseal the container multiple times. The internal threads taper in such a way that the cap may be forced onto the bottle neck by expanding the sidewalls as the cap is forced over the bottle neck threads.

In the above descriptions and in the drawing, threads protrude inward within the cap to engage threads that protrude outward from the bottle neck. Thus, threads are a particular type of male protrusions by which the cap engages the bottle neck. Other types of male protrusions can be used in other embodiments such that these descriptions and drawings relate as well to other such male protrusions. For example, rings or partial rings (non-helical) can be used as inward extending male protrusions in the cap to engage outward extending male protrusions on the bottle neck. Thus, although the illustrated embodiment has threads, simple male details can be used that can be snapped past and able to be cleared when the cap is squeezed. For example, a male standing rib similar to a thread but entirely horizontal.

After the tamper-proof ring has been broken, the cap may be replaced by snapping it on directly onto the bottle neck. As the male protrusions of the cap are pushed past the male protrusions of the bottle neck, the hollow protrusions allow the walls containing the male protrusions of the cap to flex outward as they ramp past the male protrusions of the bottle neck. The tamper-proof ring disallows this flexure by holding these walls in the original cylindrical form.

Particular embodiments and features have been described with reference to the drawings. It is to be understood that these descriptions are not limited to any single embodiment or any particular set of features, and that similar embodiments and features may arise or modifications and additions may be made without departing from the scope of these descriptions and the spirit of the appended claims.

What is claimed is:

1. An improved releasable container cap comprising:

a circular top piece for sealing a container, the container defining a length with a longitudinal axis extending therealong;

two sidewall sections connected to the top piece, each sidewall section having at least one internal male protrusion for engaging at least one male protrusion of the container, each sidewall section having two circumferential ends, wherein each circumferential end of each sidewall section is spaced from an adjacent circumferential end of the other sidewall section such that two diametrically opposed expandable gaps are defined between the spaced circumferential ends; and two tabs formed as hollow protrusions, each spanning a respective one of the two gaps, the tabs bulging outward from the otherwise cylindrical sidewall sections, wherein the tabs are configured to be pressed inward towards a respective one of the two gaps thereby causing the sidewall sections and the respective internal male protrusion to flex outward to disengage the male protrusions of the container permitting the cap to be removed therefrom, wherein the cap is configured to be removed from the male portion by lifting the cap along the longitudinal axis away from the container after the tabs are pressed inward causing the sidewall sections to flex outwardly, wherein the cap is configured to be removed without rotation along the longitudinal axis.

2. The container cap of claim 1, wherein each said tab comprises:

two ends each connected to a respective sidewall section adjacent a circumferential end of the sidewall section; and a central part between and affixed to the two ends of the tab, the central part spanning the respective gap and forming an enclosed volume such that it adds additional internal volume that exceeds the cylindrical volume formed by the sidewall sections.

3. The container cap of claim 2, wherein the two diametrically opposed expandable gaps expand when the sidewall sections flex outward.

4. The container cap of claim 1, wherein the tabs are tapered, reducing radially toward the top piece.

5. The container cap of claim 1, wherein the tabs are configured to be pressed inward along a first diametric axis causing the sidewall sections to flex outward in opposite directions along a second diametric axis perpendicular to the first diametric axis.

6. The container cap of claim 1, wherein the tabs on opposing ends of the cylinder provide additional perimeter circumference to the partial cylinder formed by the two sidewall sections, thereby allowing the sidewall section to snap over the male protrusions on the bottle neck when the cap is forced onto the bottle neck in the axial direction of the bottle neck.

7. The container cap of claim 1, wherein when the cap is first affixed to the bottle, the tamper-proof ring holds the sidewall sections in a fixed cylindrical form that does not allow the sidewall sections to flex until the frangible strips have been broken; and wherein the cap is configured to be removed without rotation along the longitudinal axis after the frangible strips are broken.

8. The container cap of claim 1, wherein the at least one male protrusion of each sidewall section comprises threads having tapered circumferential ends.

9. The container cap of claim 1, further comprising a tamper-proof ring attached to the sidewall sections by frangible strips.

10. A container and an improved releasable cap, the container defining a length with a longitudinal axis extending therealong and comprising a neck having external threads, the cap comprising:

a circular top piece for sealing the container;

two sidewall sections connected to the top piece, each sidewall section having an internal male protrusion for engaging a male protrusion of the neck of the container, each sidewall section having two circumferential ends, wherein each circumferential end of each sidewall section is spaced from an adjacent circumferential end of the other sidewall section such that two diametrically opposed expandable gaps are defined between the spaced circumferential ends; and two tabs each spanning a respective one of the two gaps, the tabs bulging outward from the sidewall sections, wherein the tabs are configured to be pressed inward towards a respective one of the two gaps thereby causing the sidewall sections and the respective internal male protrusion to flex outward to disengage the male protrusions thereof from the male protrusions of the neck of the container permitting the cap to be removed therefrom, wherein the cap is configured to be removed from the male portion by lifting the cap along the longitudinal axis away from the container after the tabs are pressed inward causing the sidewall sections to flex outwardly, wherein the cap is configured to be removed without rotation along the longitudinal axis.

11. The container and improved releasable cap of claim 10, wherein each said tab comprises:

two ends each connected to a respective sidewall section adjacent a circumferential end of the sidewall section; and a central part between and affixed to the two ends of the tab, the central part spanning the respective gap.

12. The container and improved releasable cap of claim 11, wherein the two diametrically opposed expandable gaps expand when the sidewall sections flex outward.

13. The container and improved releasable cap of claim 10, wherein the tabs are tapered, reducing radially toward the top piece.

14. The container and improved releasable cap of claim 10, wherein the tabs are configured to be pressed inward along a first diametric axis causing the sidewall sections to flex outward in opposite directions along a second diametric axis perpendicular to the first diametric axis.

15. The container and improved releasable cap of claim 10, wherein the male protrusions of each sidewall section comprises threads having tapered circumferential ends that correspond to threads on the container neck.

16. The container and improved releasable cap of claim 10, further comprising a tamper-proof ring attached to the sidewall sections by integrally molded frangible strips.

* * * * *